US009711913B2

(12) United States Patent
Aviv et al.

(10) Patent No.: US 9,711,913 B2
(45) Date of Patent: Jul. 18, 2017

(54) ILLUMINATED SOCKET

(71) Applicant: Intel Corporation, Santa Clara, CA (US)

(72) Inventors: Ron Aviv, Nir Moshe (IL); Tomer Rider, Naahryia (IL); Yair Giwnewer, Haifa (IL); Yevgeniy Kiveisha, Bney Aish (IL)

(73) Assignee: Intel Corporation, Santa Clara, CA (US)

( * ) Notice: Subject to any disclaimer, the term of this patent is extended or adjusted under 35 U.S.C. 154(b) by 94 days.

(21) Appl. No.: 14/040,645

(22) Filed: Sep. 28, 2013

(65) Prior Publication Data

US 2015/0091450 A1 Apr. 2, 2015

(51) Int. Cl.
*H05B 37/02* (2006.01)
*H01R 13/717* (2006.01)

(52) U.S. Cl.
CPC ..... *H01R 13/717* (2013.01); *H05B 37/029* (2013.01); *H01R 13/7175* (2013.01)

(58) Field of Classification Search
CPC .. H05B 37/02; H05B 37/0209; H05B 37/029; H01R 13/717; H01R 13/7175
USPC ..... 315/151, 152, 159, 291, 307
See application file for complete search history.

(56) References Cited

U.S. PATENT DOCUMENTS

| | | | | |
|---|---|---|---|---|
| 7,121,707 | B2 * | 10/2006 | Currie | H01R 13/7172 362/311.02 |
| 9,022,605 | B2 * | 5/2015 | Bushnell | H01R 13/631 320/107 |
| 2008/0233780 | A1 * | 9/2008 | Waters | H01R 25/003 439/214 |
| 2011/0222266 | A1 * | 9/2011 | Beermann | H04N 5/44513 362/85 |

* cited by examiner

*Primary Examiner* — Jimmy Vu
(74) *Attorney, Agent, or Firm* — Alpine Technology Law Group LLC

(57) ABSTRACT

In one embodiment an electronic device comprises a housing, a socket in the housing to receive a connector, and an illumination source proximate the socket to illuminate the socket. Other embodiments may be described.

10 Claims, 10 Drawing Sheets

ILLUMINATED SOCKET

RELATED APPLICATIONS

None.

BACKGROUND

The subject matter described herein relates generally to the field of electronic devices and more particularly to illuminated sockets in electronic devices.

Electronic devices such as laptops, desktops, tablet devices, mobile phones, electronic readers, and the like commonly include multiple sockets to receive connectors for charging or to couple with other devices. Electronic devices are frequently used in poor lighting conditions which can make it difficult to locate the appropriate socket on the device. Accordingly, techniques to illuminate a socket may find utility.

BRIEF DESCRIPTION OF THE DRAWINGS

The detailed description is described with reference to the accompanying figures.

DETAILED DESCRIPTION

In the following description, numerous specific details are set forth to provide a thorough understanding of various embodiments. However, it will be understood by those skilled in the art that the various embodiments may be practiced without the specific details. In other instances, well-known methods, procedures, components, and circuits have not been illustrated or described in detail so as not to obscure the particular embodiments.

Described herein are exemplary electronic devices adapted to include an illuminated socket. Various embodiments described herein adapt enable electronic devices, e.g., smart phones, laptop computers, tablet computers, electronic readers, and desktop computers and the like to include one or more illuminated sockets. By way of example, sockets for power cords, universal serial bus (USB) connectors, high-definition multimedia interface (HDMI) connectors, audio/visual (A/V) connectors, or the like. Further, in some examples the electronic device may be provided with one or more sensors to monitor conditions in the environment surrounding the socket and logic to manage conditions under which the socket(s) may be illuminated.

Figure 1:
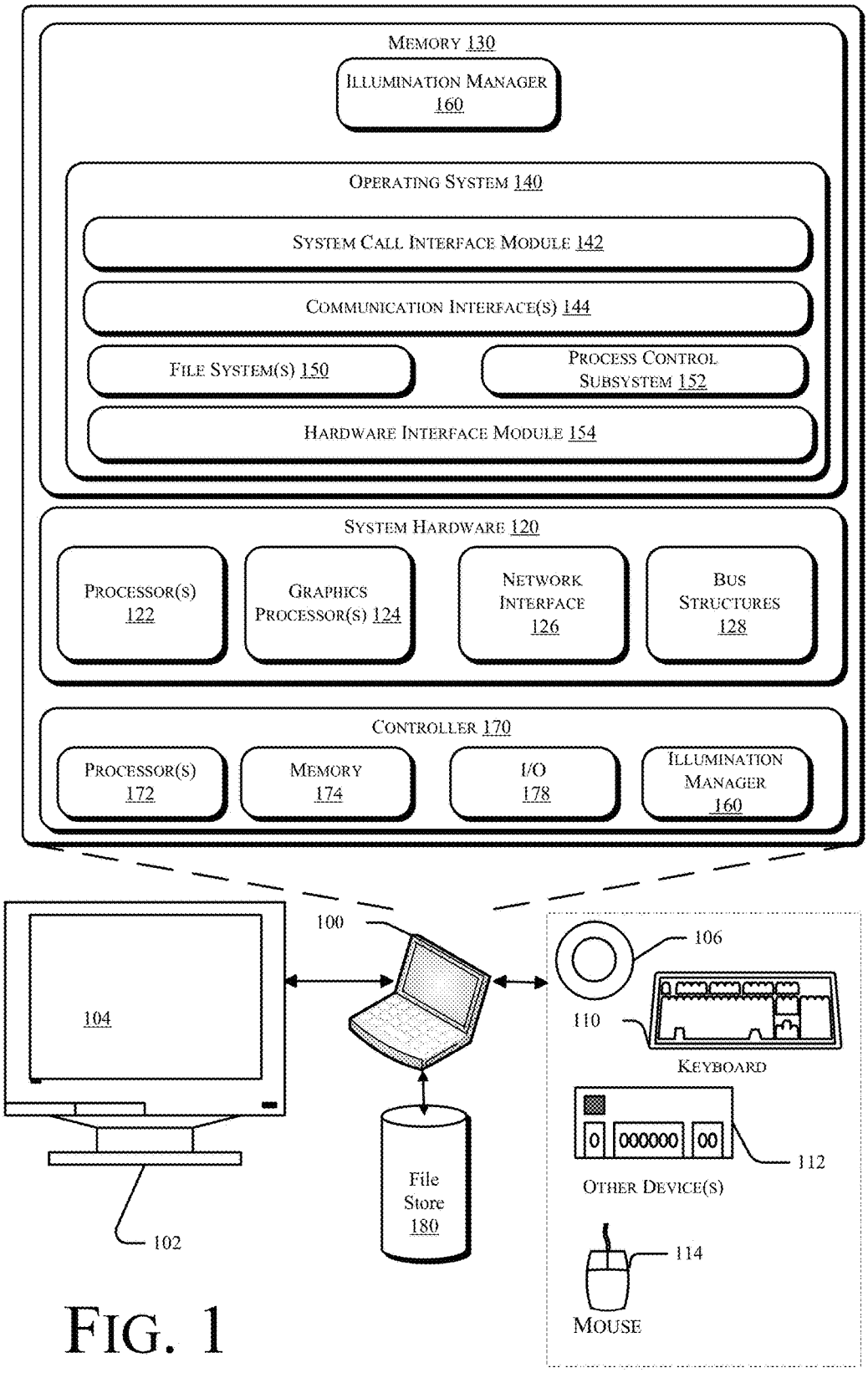
FIGS. 1-2 are schematic illustrations of exemplary electronic devices which may be adapted to include an illuminated socket in accordance with some embodiments.

FIG. 1 is a schematic illustration of an electronic device 100 which may be adapted to include an illuminated socket in accordance with some examples. In one example, electronic device 100 includes one or more accompanying input/output devices including a display 102 having a screen 104, one or more speakers 106, a keyboard 110, one or more other I/O device(s) 112, and a mouse 114. The other I/O device(s) 112 may include a touch screen, a voice-activated input device, a track ball, a geolocation device, an accelerometer/gyrometer and any other device that allows the electronic device 100 to receive input from a user.

In various embodiments, the electronic device 100 may be embodied as a personal computer, a laptop computer, a personal digital assistant, a mobile telephone, an entertainment device, or another computing device. The electronic device 100 includes system hardware 120 and memory 130, which may be implemented as random access memory and/or read-only memory. A file store 180 may be communicatively coupled to electronic device 100. File store 180 may be internal to computing device 108 such as, e.g., one or more hard drives, CD-ROM drives, DVD-ROM drives, or other types of storage devices. File store 180 may also be external electronic device 100 such as, e.g., one or more external hard drives, network attached storage, or a separate storage network.

System hardware 120 may include one or more processors 122, graphics processors 124, network interfaces 126, and bus structures 128. In one embodiment, processor 122 may be embodied as an Intel® Core2 Duo® processor available from Intel Corporation, Santa Clara, Calif., USA. As used herein, the term "processor" means any type of computational element, such as but not limited to, a microprocessor, a microcontroller, a complex instruction set computing (CISC) microprocessor, a reduced instruction set (RISC) microprocessor, a very long instruction word (VLIW) microprocessor, or any other type of processor or processing circuit.

Graphics processor(s) 124 may function as adjunct processor that manages graphics and/or video operations. Graphics processor(s) 124 may be integrated into the packaging of processor(s) 122, onto the motherboard of computing system 100 or may be coupled via an expansion slot on the motherboard.

In one embodiment, network interface 126 could be a wired interface such as an Ethernet interface (see, e.g., Institute of Electrical and Electronics Engineers/IEEE 802.3-2002) or a wireless interface such as an IEEE 802.11a, b or g-compliant interface (see, e.g., IEEE Standard for IT-Telecommunications and information exchange between systems LAN/MAN—Part II: Wireless LAN Medium Access Control (MAC) and Physical Layer (PHY) specifications Amendment 4: Further Higher Data Rate Extension in the 2.4 GHz Band, 802.11G-2003). Another example of a wireless interface would be a general packet radio service (GPRS) interface (see, e.g., Guidelines on GPRS Handset Requirements, Global System for Mobile Communications/GSM Association, Ver. 3.0.1, December 2002).

Bus structures 128 connect various components of system hardware 128. In one embodiment, bus structures 128 may be one or more of several types of bus structure(s) including a memory bus, a peripheral bus or external bus, and/or a local bus using any variety of available bus architectures including, but not limited to, 11-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

Memory 130 may include an operating system 140 for managing operations of computing device 108. In one embodiment, operating system 140 includes a hardware interface module 154 that provides an interface to system hardware 120. In addition, operating system 140 may include a file system 150 that manages files used in the operation of computing device 108 and a process control subsystem 152 that manages processes executing on electronic device 100.

Operating system 140 may include (or manage) one or more communication interfaces that may operate in conjunction with system hardware 120 to transceive data packets and/or data streams from a remote source. Operating system 140 may further include a system call interface module 142 that provides an interface between the operating system 140 and one or more application modules resident in memory 130. Operating system 140 may be embodied as a UNIX operating system or any derivative thereof (e.g., Linux, Solaris, etc.) or as a Windows® brand operating system, or other operating systems.

Memory 130 may comprise one or more applications which execute on the processor(s) 122. The applications may be stored in permanent memory such as file store 180 when not in use by the electronic device 100. In use, the applications may be copied into memory 130 for execution. In the embodiment depicted in FIG. 1 the applications comprise an illumination manager 160.

In some embodiments electronic device 100 may comprise a low-power embedded processor, referred to herein as a controller 170. The controller 170 may be implemented as an independent integrated circuit located on the motherboard of the system 100. In the embodiment depicted in FIG. 1 the controller 170 comprises a processor 172, a memory module 174, and an I/O module 176. In some embodiments the memory module 174 may comprise a persistent flash memory module and the authentication module 174 may be implemented as logic instructions encoded in the persistent memory module, e.g., firmware or software. The I/O module 178 may comprise a serial I/O module or a parallel I/O module. Because the adjunct controller 170 is physically separate from the main processor(s) 122 and operating system 140, the adjunct controller 170 may be made secure, i.e., inaccessible to hackers such that it cannot be tampered with. In some embodiments the illumination manager 160 may be implemented in the controller 170 such that the illumination manager 160 operates in a low power consumption environment.

Figure 2:
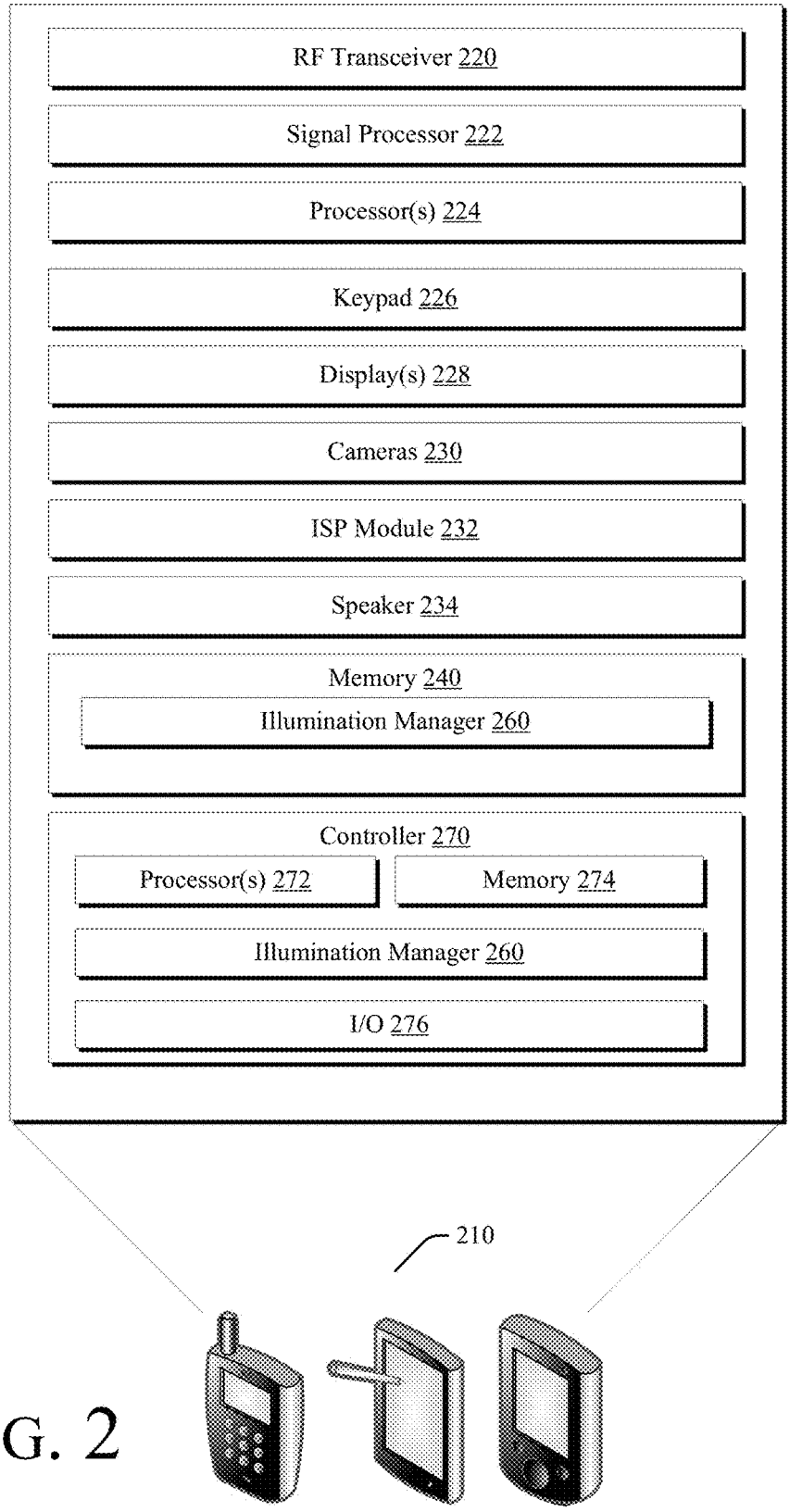

FIG. 2 is a schematic illustration of another embodiment of an electronic device 210 which may be adapted to include an illuminated socket, according to embodiments. In some embodiments electronic device 210 may be embodied as a mobile telephone, a personal digital assistant (PDA), a tablet computer, or the like. Electronic device 210 may include an RF transceiver 220 to transceive RF signals and a signal processing module 222 to process signals received by RF transceiver 220.

RF transceiver 220 may implement a local wireless connection via a protocol such as, e.g., Bluetooth or 802.11X. IEEE 802.11a, b or g-compliant interface (see, e.g., IEEE Standard for IT-Telecommunications and information exchange between systems LAN/MAN—Part II: Wireless LAN Medium Access Control (MAC) and Physical Layer (PHY) specifications Amendment 4: Further Higher Data Rate Extension in the 2.4 GHz Band, 802.11G-2003). Another example of a wireless interface would be a general packet radio service (GPRS) interface (see, e.g., Guidelines on GPRS Handset Requirements, Global System for Mobile Communications/GSM Association, Ver. 3.0.1, December 2002).

Electronic device 210 may further include one or more processors 224 and a memory module 240. As used herein, the term "processor" means any type of computational element, such as but not limited to, a microprocessor, a microcontroller, a complex instruction set computing (CISC) microprocessor, a reduced instruction set (RISC) microprocessor, a very long instruction word (VLIW) microprocessor, or any other type of processor or processing circuit. In some embodiments, processor 224 may be one or more processors in the family of Intel® PXA27x processors available from Intel® Corporation of Santa Clara, Calif. Alternatively, other CPUs may be used, such as Intel's Itanium®, XEON™, ATOM™, and Celeron® processors. Also, one or more processors from other manufactures may be utilized. Moreover, the processors may have a single or multi core design.

In some embodiments, memory module 240 includes random access memory (RAM); however, memory module 240 may be implemented using other memory types such as dynamic RAM (DRAM), synchronous DRAM (SDRAM), and the like. Memory 240 may comprise one or more applications which execute on the processor(s) 222. In the embodiment depicted in FIG. 2 the applications comprise an illumination manager 260.

Electronic device 210 may further include one or more input/output interfaces such as, e.g., a keypad 226 and one or more displays 228. In some embodiments electronic device 210 comprises one or more camera modules 230 and an image signal processor 232, and speakers 234.

In some embodiments electronic device 210 may include a controller 270 which may be implemented in a manner analogous to that of controller 170, described above. In the embodiment depicted in FIG. 2 the adjunct controller 270 comprises one or more processor(s) 272, a memory module 274, and an I/O module 276. In some embodiments the memory module 274 may comprise a persistent flash memory module and the authentication module 276 may be implemented as logic instructions encoded in the persistent memory module, e.g., firmware or software. The I/O module 276 may comprise a serial I/O module or a parallel I/O module. Again, because the adjunct controller 270 is physically separate from the main processor(s) 224, the adjunct controller 270 may be made secure, i.e., inaccessible to hackers such that it cannot be tampered with. In some embodiments the illumination manager 260 may be implemented in the controller 270 such that the illumination manager 260 operates in a low power consumption environment.

Figure 3:
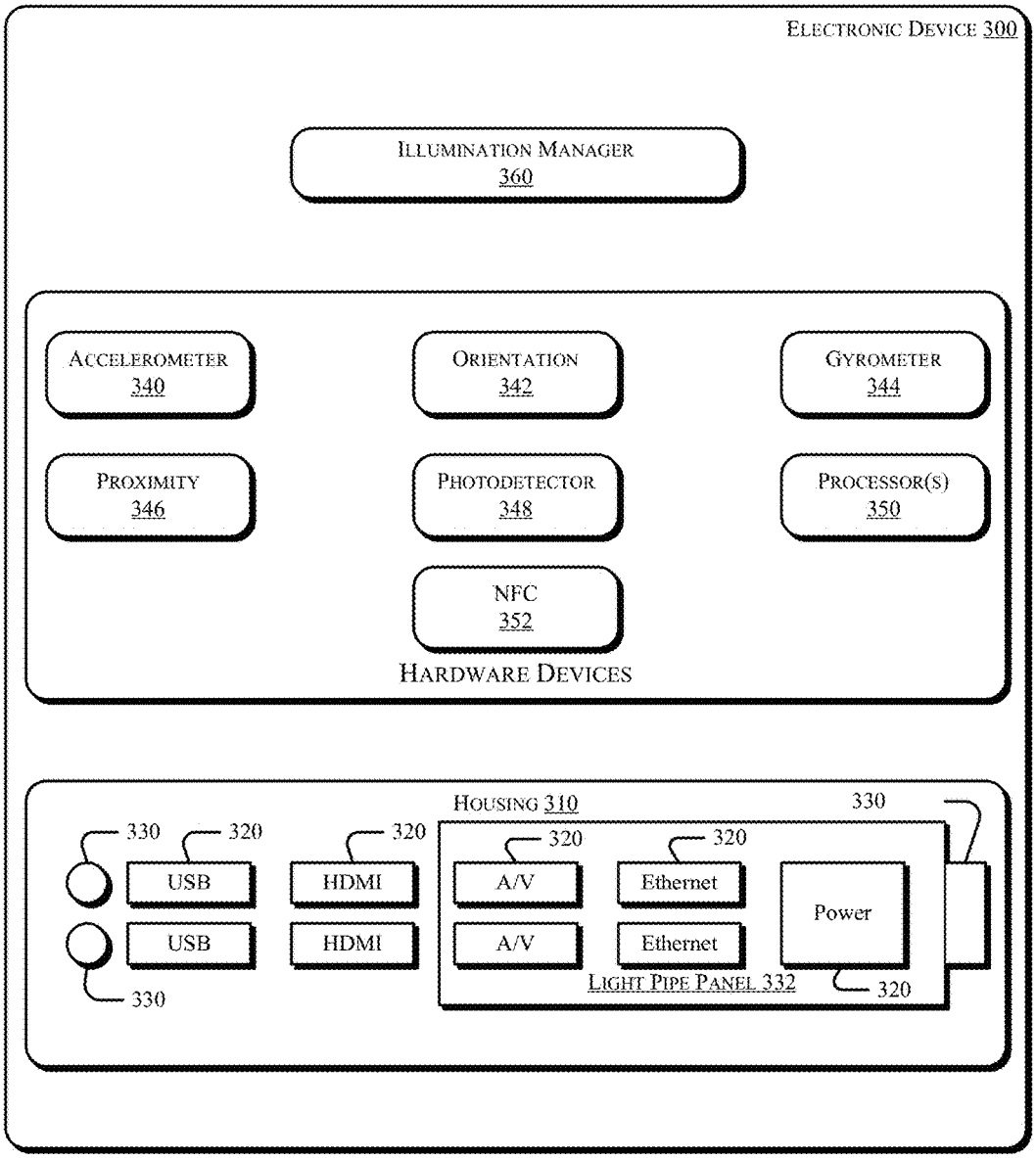
FIG. 3 is a high-level schematic illustration of an exemplary architecture for an electronic device adapted to include an illuminated socket in accordance with some embodiments.

FIG. 3 is a high-level schematic illustration of an exemplary architecture for an electronic device adapted to include an illuminated socket in accordance with some embodiments. Referring to FIG. 3, an electronic device 300 may comprise a housing 310 which includes one or more sockets 320 to receive a connector to couple the electronic device 300 with an external device. The specific type of socket 320 is not critical. Many electronic devices are equipped with one or more universal serial bus (USB) sockets, high-definition multimedia interface (HDMI) sockets, audio/visual (A/V) sockets, power sockets or the like.

As described herein, an illumination source such as one or more light emitting diodes (LEDs) 330 may be positioned proximate the socket(s) 320 to illuminate the environment proximate the socket(s) 320. The light emitting diode(s) 330 may be pointed directed into the ambient environment. Alternatively, or in addition, the light emitting diode(s) 330 may be coupled to a light pipe panel 332 which surrounds at least a portion of the sockets 320. Light pipe panel 332 may be implemented as a panel formed from a light-transmissive material, e.g., a polymer or glass. Light from LED 330 may be injected at a first end of light pipe pane. 332 and propagates along the length of panel 332, typically via total internal reflection (TIR). Light pipe panel 332 may include diffusers which may be implemented as impurities that cause light incident on the impurity to reflect at an angle outside the TIR angle such that it is emitted from the front surface of the panel 332. Alternatively, the panel 332 may include a structured surface that allows light to be emitted or may be made from a material that has a graded index of refraction along its length such that light exits the panel 332.

Electronic device 300 may comprise one or more sensors such as an accelerometer 340, an orientation sensor 342, a gyrometer 344, a proximity detector 346, or a photodetector 348 and a near field communication (NFC) device 352. An illumination manager 360 in an electronic device 300 may be implemented as logic instructions executable on one or more processors 350, i.e., as software, firmware or the like. Alternatively, illumination manager may be reduced to hard-wired circuitry, e.g., as an application specific integrated circuit (ASIC) or as a portion of an integrated circuit in electronic device 300.

As described above, in some embodiments the illumination manager 360 implements logic which enables a user of electronic device 300 to configure the illumination source(s) 330 to illuminate the environment surrounding the socket(s) 320 in response to environmental conditions. In some embodiments the illumination manager 360 monitors conditions proximate the one or more socket(s) 320 via the sensors and activates the illumination source 330 in response to a determination that at least one of the conditions are satisfied. Operations implemented by illumination manager 360 will be described with reference to FIG. 4 and FIG. 5.

Figure 4:
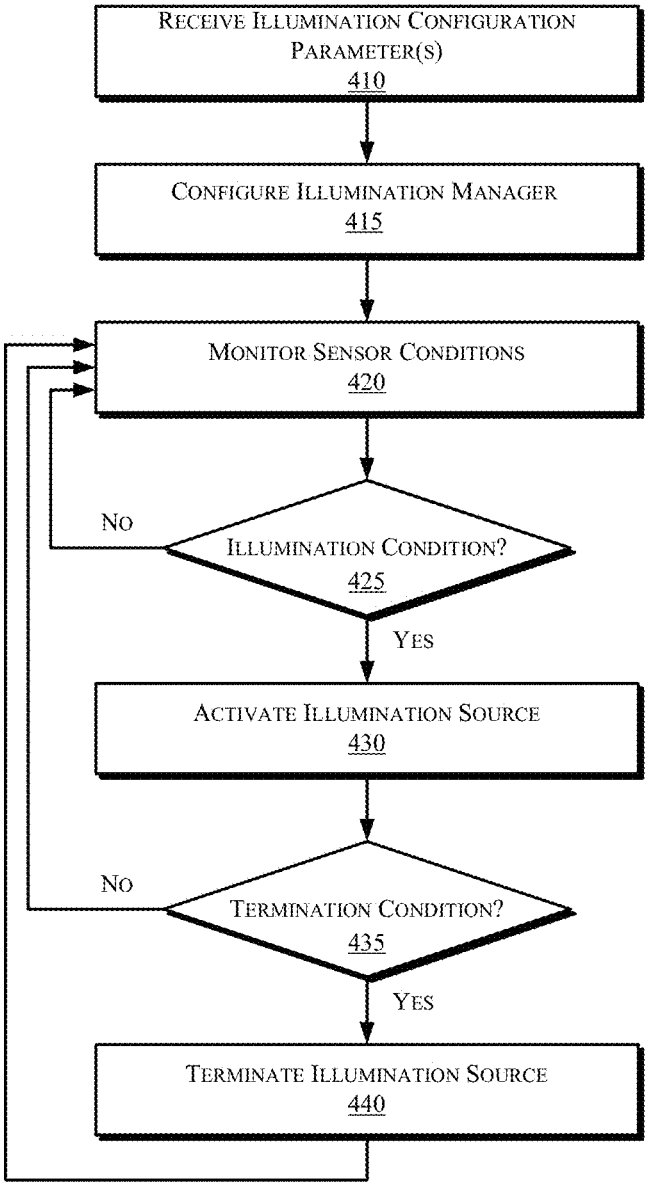
FIG. 4 is a flowchart illustrating operations implemented by an illumination manager in an electronic device which may be adapted to include an illuminated socket in accordance with some embodiments.
Figure 5:
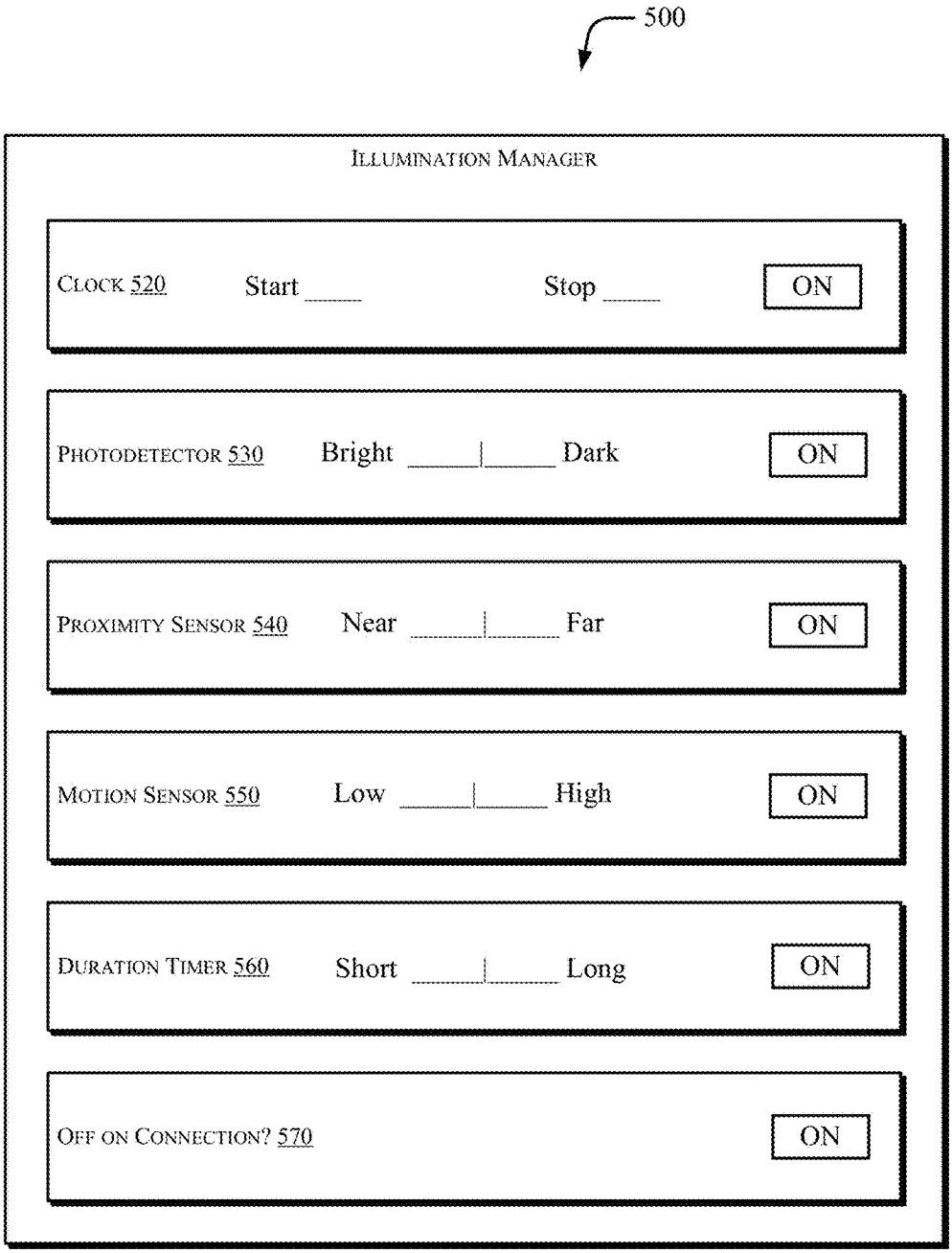
FIG. 5 is a schematic illustration of a configuration menu implemented by an illumination manager in an electronic device which may be adapted to include an illuminated socket in accordance with some embodiments.

FIG. 4 is a flowchart illustrating operations implemented by illumination manager 360 in an electronic device 300. Referring to FIG. 4, at operation 410 the illumination manager receives one or more illumination configuration parameters. In some examples the illumination manager may present an interactive user interface, such as the user interface 500 depicted in FIG. 5, through which a user may enter one or more illumination configuration parameters.

For example, the configuration parameters may include a clock parameter 510 which allows a user to enter a start time at which the illumination source 330 may be activated and a stop time after which the illumination source 330 may not be activated. If the clock parameter is set to ON then the illumination source 330 may be illuminated only between the start time and the stop time. By contrast, if the clock parameter is set to OFF then there are no time limitations are enforced.

The configuration parameters may further include a photodetector parameter which allows a user to enter a brightness level above which the illumination source will not be operable. If the photodetector parameter is set to ON then the illumination source 330 may be illuminated only when the photodetector output is below the selected brightness. By contrast, if the photodetector parameter is set to OFF then there are no brightness limitations are enforced.

The configuration parameters may further include a proximity sensor parameter 540 which allows a user to enter a proximity level. If the proximity sensor is set to ON then when the proximity sensor detects an object that is closer than the proximity sensor parameter the illumination source 330 may be illuminated. By contrast, if the photodetector parameter is set to OFF then there are no proximity limitations are enforced.

The configuration parameters may further include a motion sensor parameter 550 which allows a user to enter a motion detector sensitivity level. If the motion sensor is set to ON then when the motion sensor detects an object moving the illumination source 330 may be illuminated. By contrast, if the motion sensor parameter is set to OFF then there are no brightness limitations enforced.

The configuration parameters may further include a duration timer parameter 560 which allows a user to enter a time duration for which the illumination sources are to remain activated. If the time duration parameter is set to ON then the illumination source 330 may be illuminated for a time duration indicated by the time duration parameter. By contrast, if the motion sensor parameter is set to OFF then there are no time duration limitations enforced.

The configuration parameters may further include off on connection parameter 570 which allows a user to select whether the illumination source 330 should be turned off when a connection to an external device is detected on one of the sockets. If the time duration parameter is set to ON then the illumination source 330 may be turned off when a connection is detected. By contrast, if the motion sensor parameter is set to OFF then there are no connection limitations enforced.

In various examples the illumination manager may allow a user to enter more or fewer configuration parameters via the user interface 500. Once entered, the parameters are used to configure (operation 415) the illumination manager.

At operation 420 the illumination manager 360 monitors the sensor conditions by monitoring the outputs of the various sensors on the electronic device 300. If, at operation 425 none of the sensors produce an output which indicates that one or more of the illumination configuration parameters are satisfied then control passes back to operation 420 and the illumination manager 360 continues to monitor the sensor conditions.

By contrast, if at operation 425 one or more of sensors produce an output which indicates that the illumination conditions are satisfied then control passes to operation 430 and the illumination source(s) 330 are activated to illuminate the environment proximate the socket(s) 320.

For example, a user may configure the illumination manager 360 to activate the illumination source(s) 330 only when an output from the photodetector 348 indicates that the environment proximate the at least one socket is dark, and/or only when an output from the proximity detector 346 indicates that an object is proximate the at least one socket 320, and/or in response to a motion imparted to the electronic device.

For example, the near field communication (NFC) device 352 may be configured to detect when a near field communication (NFC) device on a male plug adapted to mate with one or more of the socket(s) 320 is in communication with the NFC device 352.

If, at operation 435 a termination condition is not satisfied then control passes back to operation 420 and the illumination manager 360 continues to monitor the sensor conditions. By contrast, if at operation 435 a termination condition is satisfied then control passes to operation 440 and the illumination manager 360 terminates the illumination source.

For example, the configuration manager 360 may deactivate the illumination source 330 after a predetermined period of time, and or in response to detecting a connection with a remote device on the socket.

Thus, the illumination manager 360 enables a user of the electronic device 300 to set configuration parameters which are then used to manage the illumination of illumination source(s) 330. It will be recognized that additional configuration parameters may be incorporated into the configuration manager 360.

Figure 6:
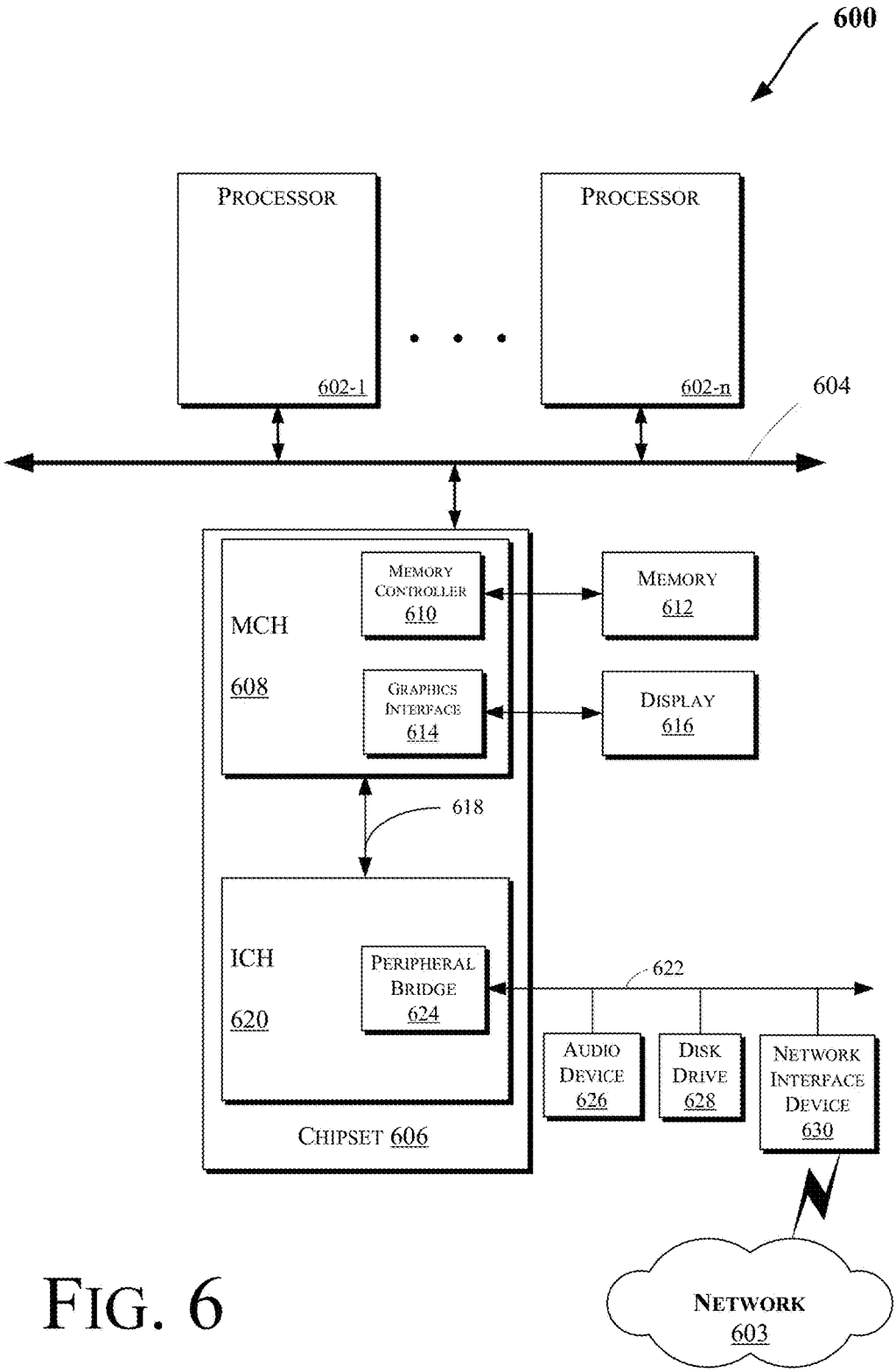
FIGS. 6-10 are schematic illustrations of electronic devices which may be adapted to include an illuminated socket in accordance with some embodiments.

As described above, in some embodiments the electronic device may be embodied as a computer system. FIG. 6 illustrates a block diagram of a computing system 600 in accordance with an embodiment of the invention. The computing system 600 may include one or more central processing unit(s) (CPUs) 602 or processors that communicate via an interconnection network (or bus) 604. The processors 602 may include a general purpose processor, a network processor (that processes data communicated over a computer network 603), or other types of a processor (including a reduced instruction set computer (RISC) processor or a complex instruction set computer (CISC)). Moreover, the processors 602 may have a single or multiple core design. The processors 602 with a multiple core design may integrate different types of processor cores on the same integrated circuit (IC) die. Also, the processors 602 with a multiple core design may be implemented as symmetrical or asymmetrical multiprocessors. In an embodiment, one or more of the processors 602 may be the same or similar to the processors 102 of FIG. 1. For example, one or more of the processors 602 may include the control unit 120 discussed with reference to FIGS. 1-3. Also, the operations discussed with reference to FIGS. 3-5 may be performed by one or more components of the system 600.

A chipset 606 may also communicate with the interconnection network 604. The chipset 606 may include a memory control hub (MCH) 608. The MCH 608 may include a memory controller 610 that communicates with a memory 612 (which may be the same or similar to the memory 130 of FIG. 1). The memory 412 may store data, including sequences of instructions, that may be executed by the CPU 602, or any other device included in the computing system 600. In one embodiment of the invention, the memory 612 may include one or more volatile storage (or memory) devices such as random access memory (RAM), dynamic RAM (DRAM), synchronous DRAM (SDRAM), static RAM (SRAM), or other types of storage devices. Nonvolatile memory may also be utilized such as a hard disk. Additional devices may communicate via the interconnection network 604, such as multiple CPUs and/or multiple system memories.

The MCH 608 may also include a graphics interface 614 that communicates with a display device 616. In one embodiment of the invention, the graphics interface 614 may communicate with the display device 616 via an accelerated graphics port (AGP). In an embodiment of the invention, the display 616 (such as a flat panel display) may communicate with the graphics interface 614 through, for example, a signal converter that translates a digital representation of an image stored in a storage device such as video memory or system memory into display signals that are interpreted and displayed by the display 616. The display signals produced by the display device may pass through various control devices before being interpreted by and subsequently displayed on the display 616.

A hub interface 618 may allow the MCH 608 and an input/output control hub (ICH) 620 to communicate. The ICH 620 may provide an interface to I/O device(s) that communicate with the computing system 600. The ICH 620 may communicate with a bus 622 through a peripheral bridge (or controller) 624, such as a peripheral component interconnect (PCI) bridge, a universal serial bus (USB) controller, or other types of peripheral bridges or controllers. The bridge 624 may provide a data path between the CPU 602 and peripheral devices. Other types of topologies may be utilized. Also, multiple buses may communicate with the ICH 620, e.g., through multiple bridges or controllers. Moreover, other peripherals in communication with the ICH 620 may include, in various embodiments of the invention, integrated drive electronics (IDE) or small computer system interface (SCSI) hard drive(s), USB port(s), a keyboard, a mouse, parallel port(s), serial port(s), floppy disk drive(s), digital output support (e.g., digital video interface (DVI)), or other devices.

The bus 622 may communicate with an audio device 626, one or more disk drive(s) 628, and a network interface device 630 (which is in communication with the computer network 603). Other devices may communicate via the bus 622. Also, various components (such as the network interface device 630) may communicate with the MCH 608 in some embodiments of the invention. In addition, the processor 602 and one or more other components discussed herein may be combined to form a single chip (e.g., to provide a System on Chip (SOC)). Furthermore, the graphics accelerator 616 may be included within the MCH 608 in other embodiments of the invention.

Furthermore, the computing system 600 may include volatile and/or nonvolatile memory (or storage). For example, nonvolatile memory may include one or more of the following: read-only memory (ROM), programmable ROM (PROM), erasable PROM (EPROM), electrically EPROM (EEPROM), a disk drive (e.g., 628), a floppy disk, a compact disk ROM (CD-ROM), a digital versatile disk (DVD), flash memory, a magneto-optical disk, or other types of nonvolatile machine-readable media that are capable of storing electronic data (e.g., including instructions).

Figure 7:
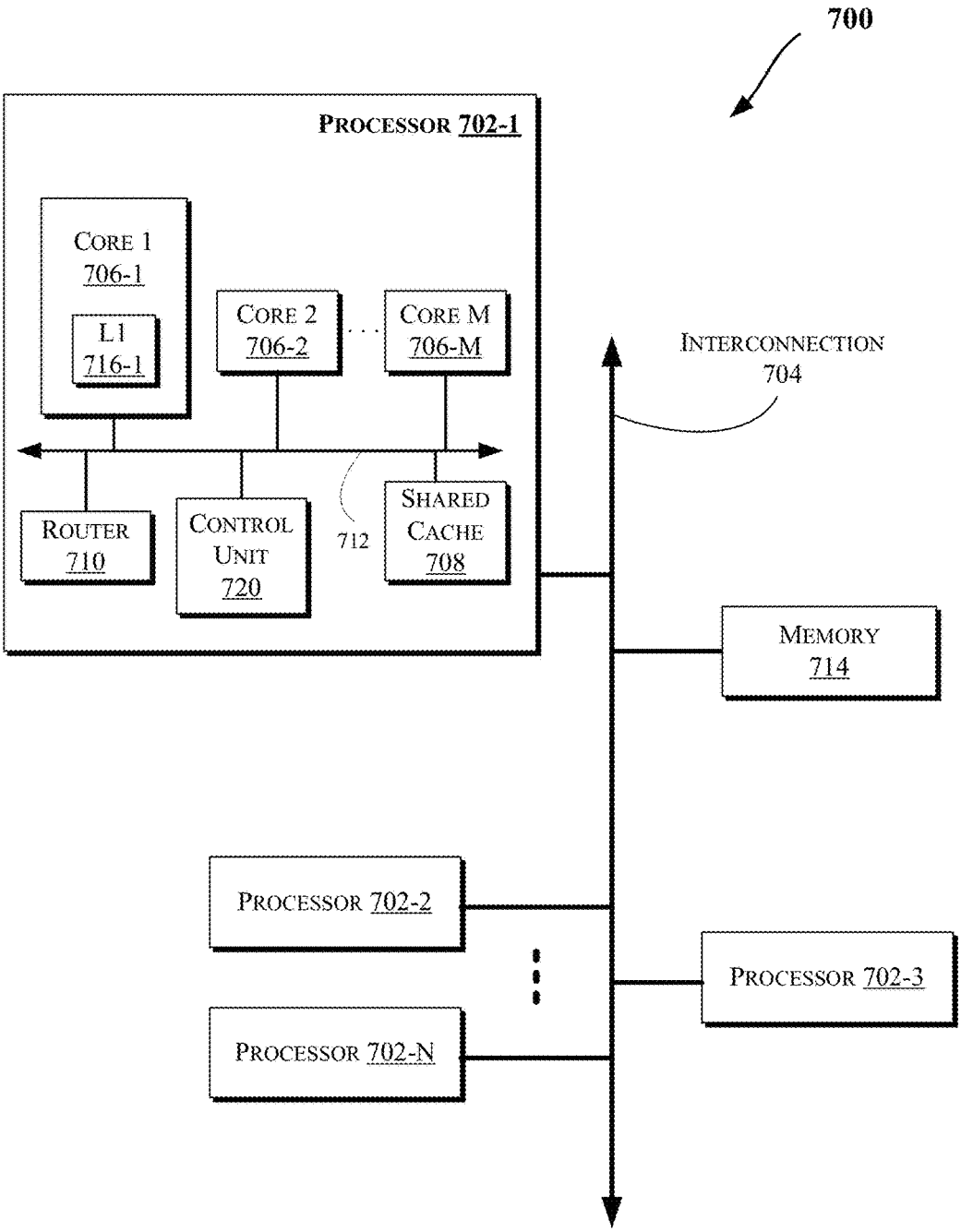

FIG. 7 illustrates a block diagram of a computing system 700, according to an embodiment of the invention. The system 700 may include one or more processors 702-1 through 702-N (generally referred to herein as "processors 702" or "processor 702"). The processors 702 may communicate via an interconnection network or bus 704. Each processor may include various components some of which are only discussed with reference to processor 702-1 for clarity. Accordingly, each of the remaining processors 702-2 through 702-N may include the same or similar components discussed with reference to the processor 702-1.

In an embodiment, the processor 702-1 may include one or more processor cores 706-1 through 706-M (referred to herein as "cores 706" or more generally as "core 706"), a shared cache 708, a router 710, and/or a processor control logic or unit 720. The processor cores 706 may be implemented on a single integrated circuit (IC) chip. Moreover, the chip may include one or more shared and/or private caches (such as cache 708), buses or interconnections (such as a bus or interconnection network 712), memory controllers, or other components.

In one embodiment, the router 710 may be used to communicate between various components of the processor 702-1 and/or system 700. Moreover, the processor 702-1 may include more than one router 710. Furthermore, the multitude of routers 710 may be in communication to enable data routing between various components inside or outside of the processor 702-1.

The shared cache 708 may store data (e.g., including instructions) that are utilized by one or more components of the processor 702-1, such as the cores 706. For example, the shared cache 708 may locally cache data stored in a memory 714 for faster access by components of the processor 702. In an embodiment, the cache 708 may include a mid-level cache (such as a level 2 (L2), a level 3 (L3), a level 4 (L4), or other levels of cache), a last level cache (LLC), and/or combinations thereof. Moreover, various components of the processor 702-1 may communicate with the shared cache 708 directly, through a bus (e.g., the bus 712), and/or a memory controller or hub. As shown in FIG. 7, in some embodiments, one or more of the cores 706 may include a level 1 (L1) cache 716-1 (generally referred to herein as "L1 cache 716"). In one embodiment, the control unit 720 may include logic to implement the operations described above with reference to the memory controller 122 in FIG. 2.

Figure 8:
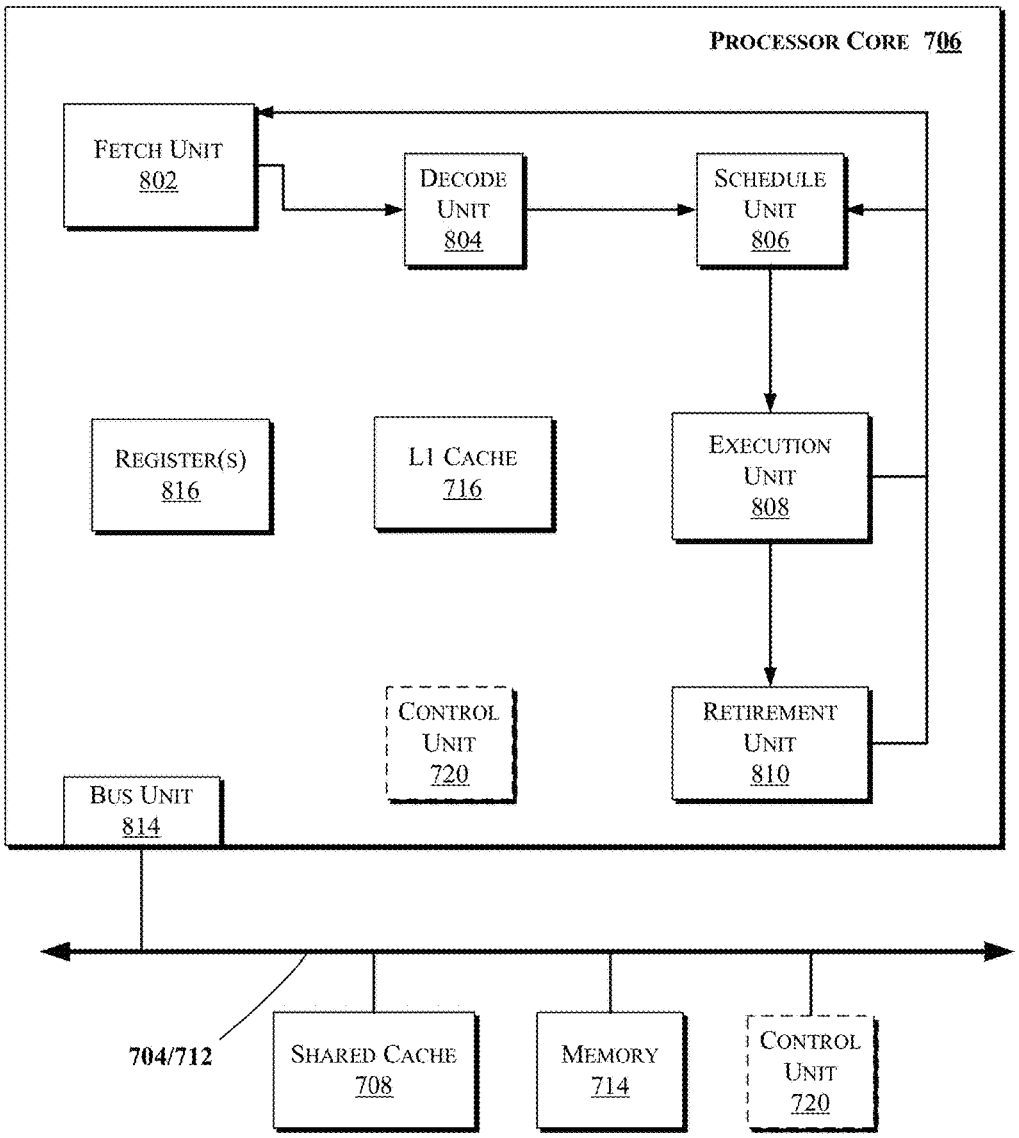

FIG. 8 illustrates a block diagram of portions of a processor core 706 and other components of a computing system, according to an embodiment of the invention. In one embodiment, the arrows shown in FIG. 8 illustrate the flow direction of instructions through the core 706. One or more processor cores (such as the processor core 706) may be implemented on a single integrated circuit chip (or die) such as discussed with reference to FIG. 7. Moreover, the chip may include one or more shared and/or private caches (e.g., cache 708 of FIG. 7), interconnections (e.g., interconnections 704 and/or 112 of FIG. 7), control units, memory controllers, or other components.

As illustrated in FIG. 8, the processor core 706 may include a fetch unit 802 to fetch instructions (including instructions with conditional branches) for execution by the core 706. The instructions may be fetched from any storage devices such as the memory 714. The core 706 may also include a decode unit 804 to decode the fetched instruction. For instance, the decode unit 804 may decode the fetched instruction into a plurality of uops (micro-operations).

Additionally, the core 706 may include a schedule unit 806. The schedule unit 806 may perform various operations associated with storing decoded instructions (e.g., received from the decode unit 804) until the instructions are ready for dispatch, e.g., until all source values of a decoded instruction become available. In one embodiment, the schedule unit 806 may schedule and/or issue (or dispatch) decoded instructions to an execution unit 808 for execution. The execution unit 808 may execute the dispatched instructions after they are decoded (e.g., by the decode unit 804) and dispatched (e.g., by the schedule unit 806). In an embodiment, the execution unit 808 may include more than one execution unit. The execution unit 808 may also perform various arithmetic operations such as addition, subtraction, multiplication, and/or division, and may include one or more an arithmetic logic units (ALUs). In an embodiment, a co-processor (not shown) may perform various arithmetic operations in conjunction with the execution unit 808.

Further, the execution unit 808 may execute instructions out-of-order. Hence, the processor core 706 may be an out-of-order processor core in one embodiment. The core 706 may also include a retirement unit 810. The retirement unit 810 may retire executed instructions after they are committed. In an embodiment, retirement of the executed instructions may result in processor state being committed from the execution of the instructions, physical registers used by the instructions being de-allocated, etc.

The core 706 may also include a bus unit 714 to enable communication between components of the processor core 706 and other components (such as the components discussed with reference to FIG. 8) via one or more buses (e.g., buses 804 and/or 812). The core 706 may also include one or more registers 816 to store data accessed by various components of the core 706 (such as values related to power consumption state settings).

Furthermore, even though FIG. 7 illustrates the control unit 720 to be coupled to the core 706 via interconnect 812, in various embodiments the control unit 720 may be located elsewhere such as inside the core 706, coupled to the core via bus 704, etc.

Figure 9:
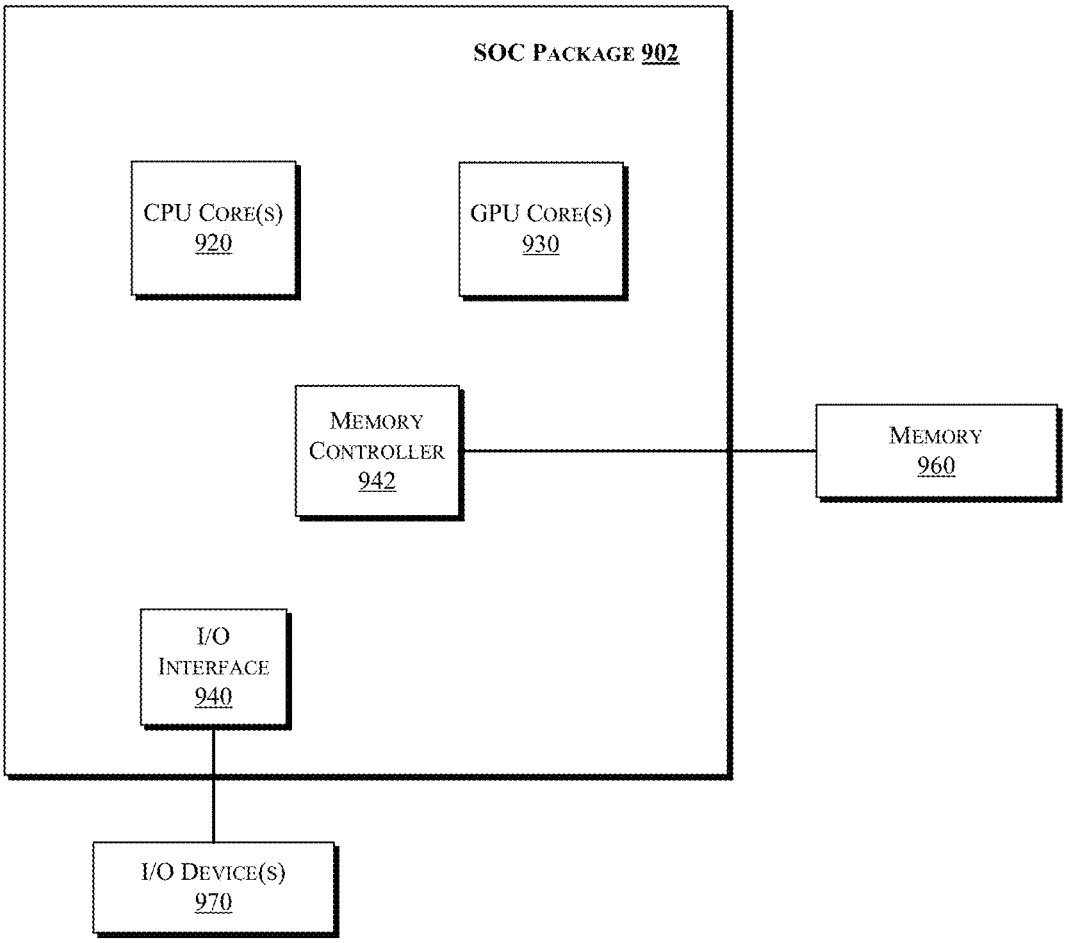

In some embodiments, one or more of the components discussed herein can be embodied as a System On Chip (SOC) device. FIG. 9 illustrates a block diagram of an SOC package in accordance with an embodiment. As illustrated in FIG. 9, SOC 902 includes one or more Central Processing Unit (CPU) cores 920, one or more Graphics Processor Unit (GPU) cores 930, an Input/Output (I/O) interface 940, and a memory controller 942. Various components of the SOC package 902 may be coupled to an interconnect or bus such as discussed herein with reference to the other figures. Also, the SOC package 902 may include more or less components, such as those discussed herein with reference to the other figures. Further, each component of the SOC package 902 may include one or more other components, e.g., as discussed with reference to the other figures herein. In one embodiment, SOC package 902 (and its components) is provided on one or more Integrated Circuit (IC) die, e.g., which are packaged into a single semiconductor device.

As illustrated in FIG. 9, SOC package 902 is coupled to a memory 960 (which may be similar to or the same as memory discussed herein with reference to the other figures) via the memory controller 942. In an embodiment, the memory 960 (or a portion of it) can be integrated on the SOC package 902.

The I/O interface 940 may be coupled to one or more I/O devices 970, e.g., via an interconnect and/or bus such as discussed herein with reference to other figures. I/O device(s) 970 may include one or more of a keyboard, a mouse, a touchpad, a display, an image/video capture device (such as a camera or camcorder/video recorder), a touch screen, a speaker, or the like.

Figure 10:
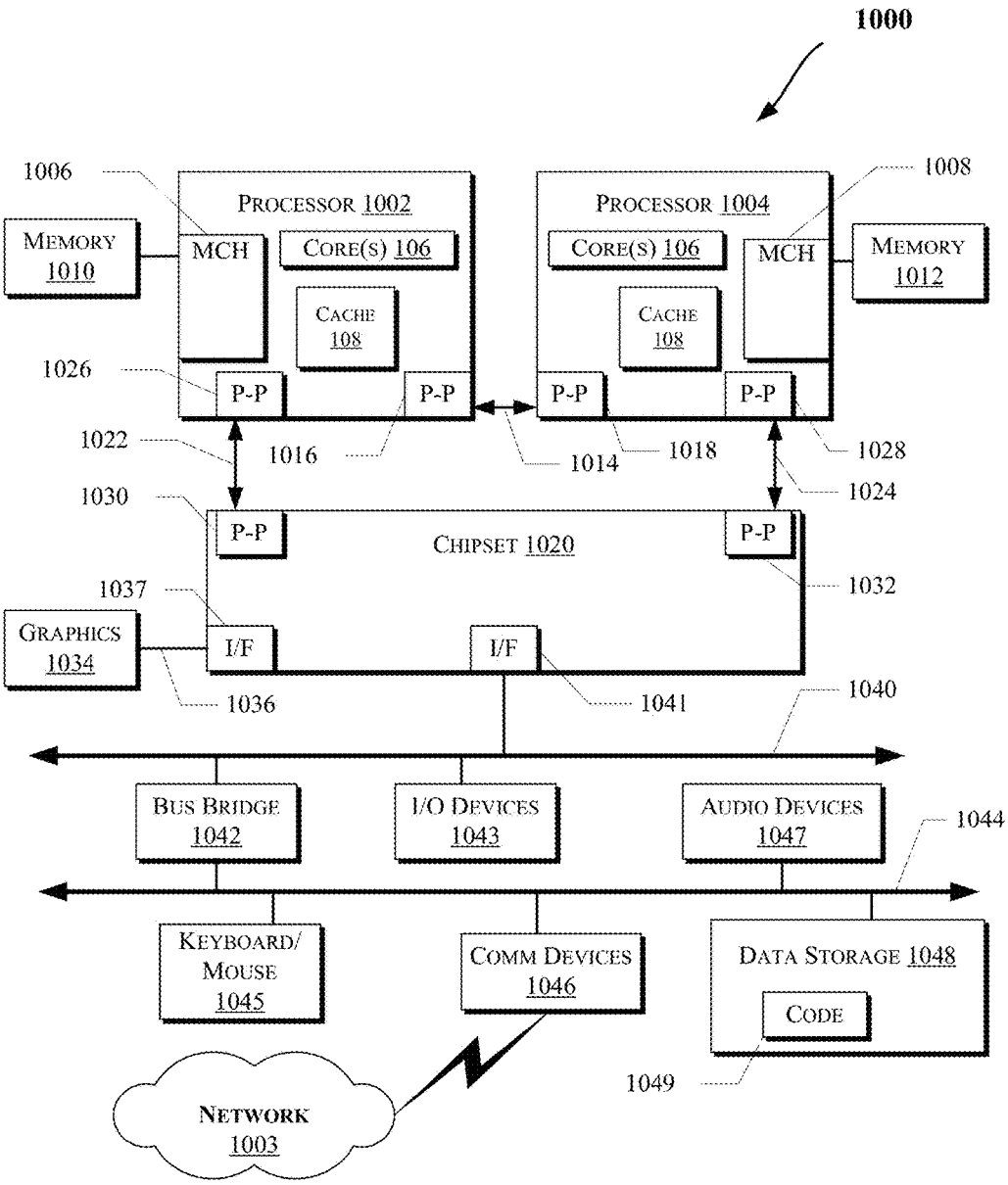

FIG. 10 illustrates a computing system 1000 that is arranged in a point-to-point (PtP) configuration, according to an embodiment of the invention. In particular, FIG. 10 shows a system where processors, memory, and input/output devices are interconnected by a number of point-to-point interfaces. The operations discussed with reference to FIG. 2 may be performed by one or more components of the system 1000.

As illustrated in FIG. 10, the system 1000 may include several processors, of which only two, processors 1002 and 1004 are shown for clarity. The processors 1002 and 1004 may each include a local memory controller hub (MCH) 1006 and 1008 to enable communication with memories 1010 and 1012. MCH 1006 and 1008 may include the memory controller 120 and/or logic 125 of FIG. 1 in some embodiments.

In an embodiment, the processors 1002 and 1004 may be one of the processors 702 discussed with reference to FIG. 7. The processors 1002 and 1004 may exchange data via a point-to-point (PtP) interface 1014 using PtP interface circuits 1016 and 1018, respectively. Also, the processors 1002 and 1004 may each exchange data with a chipset 1020 via individual PtP interfaces 1022 and 1024 using point-to-point interface circuits 1026, 1028, 1030, and 1032. The chipset 1020 may further exchange data with a high-performance graphics circuit 1034 via a high-performance graphics interface 1036, e.g., using a PtP interface circuit 1037.

As shown in FIG. 10, one or more of the cores 106 and/or cache 108 of FIG. 1 may be located within the processors 1004. Other embodiments of the invention, however, may exist in other circuits, logic units, or devices within the system 1000 of FIG. 10. Furthermore, other embodiments of the invention may be distributed throughout several circuits, logic units, or devices illustrated in FIG. 10.

The chipset 1020 may communicate with a bus 1040 using a PtP interface circuit 1041. The bus 1040 may have one or more devices that communicate with it, such as a bus bridge 1042 and I/O devices 1043. Via a bus 1044, the bus bridge 1043 may communicate with other devices such as a keyboard/mouse 1045, communication devices 1046 (such as modems, network interface devices, or other communication devices that may communicate with the computer network 1003), audio I/O device, and/or a data storage device 1048. The data storage device 1048 (which may be a hard disk drive or a NAND flash based solid state drive) may store code 1049 that may be executed by the processors 1004.

The following examples pertain to further embodiments.

Example 1 is an apparatus electronic device, comprising a housing, a socket in the housing to receive a connector, and an illumination source proximate the socket to illuminate the socket.

In Example 2, the subject matter of Example 1 can optionally include an arrangement in which the socket comprises at least one of a power socket, a universal serial bus (USB) socket, an audio/visual (AV) socket, or an Ethernet socket.

In Example 3, the subject matter of any one of Examples 1-2 can optionally include an arrangement in which the illumination source comprises a light emitting diode.

In Example 4, the subject matter of any one of Examples 1-3 can optionally include an arrangement in which the light emitting diode is coupled to a light pipe panel surrounding the socket.

In Example 5, the subject matter of any one of Examples 1-4 can optionally include logic, at least partially including hardware logic, configured to receive at least one illumination configuration parameter, monitor sensor conditions in at least one sensor proximate the socket, and activate the illumination source in response to a determination that at least one of the illumination configuration parameters are satisfied.

In Example 6, the subject matter of any one of Examples 1-5 can optionally include an arrangement in which the at least one sensor comprises a photodetector and the logic is further configured to activate the illumination source only when an output from the photodetector indicates that the environment proximate the at least one socket is dark.

In Example 7, the subject matter of any one of Examples 1-6 can optionally include an arrangement in which the at least one sensor comprises a proximity detector and the logic is further configured to activate the illumination source only when an output from the proximity detector indicates that an object is proximate the at least one socket.

In Example 8, the subject matter of any one of Examples 1-7 can optionally include an arrangement in which the electronic device comprises a first near field communication (NFC) device and the logic is further configured to activate the illumination source only when the first NFC device detects a second NFC proximate the first electronic device.

In Example 9, the subject matter of any one of Examples 1-8 can optionally include an arrangement in which the logic is further configured to deactivate the illumination source after a predetermined period of time.

In Example 10, the subject matter of any one of Examples 1-9 can optionally include logic an arrangement in which the logic is further configured to deactivate the illumination source in response to detecting a connection with a remote device on the socket.

Example 11 is an apparatus comprising logic, at least partially including hardware logic, configured to receive at least one illumination configuration parameter, monitor sensor conditions in at least one sensor proximate the socket, and activate the illumination source in response to a determination that at least one of the illumination configuration parameters are satisfied.

In Example 12, the subject matter of Example 11 can optionally include an arrangement in which the at least one sensor comprises a photodetector and the logic is further configured to activate the illumination source only when an output from the photodetector indicates that the environment proximate the at least one socket is dark.

In Example 13, the subject matter of any one of Examples 11-12 can optionally include an arrangement in which the at least one sensor comprises a proximity detector and the logic is further configured to activate the illumination source only when an output from the proximity detector indicates that an object is proximate the at least one socket.

In Example 14, the subject matter of any one of Examples 11-13 can optionally include an arrangement in which the electronic device comprises a first near field communication (NFC) device and the logic is further configured to activate the illumination source only when the first NFC device detects a second NFC proximate the first electronic device.

In Example 15, the subject matter of any one of Examples 11-14 can optionally include an arrangement in which the logic is further configured to deactivate the illumination source after a predetermined period of time.

In Example 16, the subject matter of any one of Examples 11-15 can optionally include logic an arrangement in which the logic is further configured to deactivate the illumination source in response to detecting a connection with a remote device on the socket.

Example 17 is a computer program product comprising logic instructions stored in a non-transitory computer readable medium which, when executed by a processor, configure the processor to receive at least one illumination configuration parameter, monitor sensor conditions in at least one sensor proximate the socket, and activate the illumination source in response to a determination that at least one of the illumination configuration parameters are satisfied.

In Example 18, the subject matter of Example 17 can optionally include an arrangement in which the at least one sensor comprises a photodetector and the logic is further configured to activate the illumination source only when an output from the photodetector indicates that the environment proximate the at least one socket is dark.

In Example 19, the subject matter of any one of Examples 17-18 can optionally include an arrangement in which the at least one sensor comprises a proximity detector and the logic is further configured to activate the illumination source only when an output from the proximity detector indicates that an object is proximate the at least one socket.

In Example 20, the subject matter of any one of Examples 17-19 can optionally include an arrangement in which the electronic device comprises a first near field communication (NFC) device and the logic is further configured to activate the illumination source only when the first NFC device detects a second NFC proximate the first electronic device.

In Example 21, the subject matter of any one of Examples 17-20 can optionally include an arrangement in which the logic is further configured to deactivate the illumination source after a predetermined period of time.

In Example 22, the subject matter of any one of Examples 17-21 can optionally include logic an arrangement in which the logic is further configured to deactivate the illumination source in response to detecting a connection with a remote device on the socket.

Example 23 is an apparatus comprising means to receive at least one illumination configuration parameter, monitor sensor conditions in at least one sensor proximate the socket, and activate the illumination source in response to a determination that at least one of the illumination configuration parameters are satisfied.

In Example 24, the subject matter of Example 23 can optionally include an arrangement which further comprises means to activate the illumination source only when an output from the photodetector indicates that the environment proximate the at least one socket is dark.

In Example 25, the subject matter of any one of Examples 23-24 can optionally include an arrangement which further comprising means to activate the illumination source only when an output from the proximity detector indicates that an object is proximate the at least one socket In Example 26, the subject matter of any one of Examples 23-25 can optionally include an arrangement in which the electronic device comprises a first near field communication (NFC) device and further comprising means to activate the illumination source only when the first NFC device detects a second NFC proximate the first electronic device.

In Example 27, the subject matter of any one of Examples 23-26 can optionally means to deactivate the illumination source after a predetermined period of time.

In Example 28, the subject matter of any one of Examples 23-27 can optionally means to deactivate the illumination source in response to detecting a connection with a remote device on the socket.

The terms "logic instructions" as referred to herein relates to expressions which may be understood by one or more machines for performing one or more logical operations. For example, logic instructions may comprise instructions which are interpretable by a processor compiler for executing one or more operations on one or more data objects. However, this is merely an example of machine-readable instructions and embodiments are not limited in this respect.

The terms "computer readable medium" as referred to herein relates to media capable of maintaining expressions which are perceivable by one or more machines. For example, a computer readable medium may comprise one or more storage devices for storing computer readable instructions or data. Such storage devices may comprise storage media such as, for example, optical, magnetic or semiconductor storage media. However, this is merely an example of a computer readable medium and embodiments are not limited in this respect.

The term "logic" as referred to herein relates to structure for performing one or more logical operations. For example, logic may comprise circuitry which provides one or more output signals based upon one or more input signals. Such circuitry may comprise a finite state machine which receives a digital input and provides a digital output, or circuitry which provides one or more analog output signals in response to one or more analog input signals. Such circuitry may be provided in an application specific integrated circuit (ASIC) or field programmable gate array (FPGA). Also, logic may comprise machine-readable instructions stored in a memory in combination with processing circuitry to execute such machine-readable instructions. However, these are merely examples of structures which may provide logic and embodiments are not limited in this respect.

Some of the methods described herein may be embodied as logic instructions on a computer-readable medium. When executed on a processor, the logic instructions cause a processor to be programmed as a special-purpose machine that implements the described methods. The processor, when configured by the logic instructions to execute the methods described herein, constitutes structure for performing the described methods. Alternatively, the methods described herein may be reduced to logic on, e.g., a field programmable gate array (FPGA), an application specific integrated circuit (ASIC) or the like.

In the description and claims, the terms coupled and connected, along with their derivatives, may be used. In particular embodiments, connected may be used to indicate that two or more elements are in direct physical or electrical contact with each other. Coupled may mean that two or more elements are in direct physical or electrical contact. However, coupled may also mean that two or more elements may not be in direct contact with each other, but yet may still cooperate or interact with each other.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. An apparatus comprising logic, at least partially including hardware logic, configured to:

receive at least one illumination configuration parameter;

monitor sensor conditions in at least one sensor proximate at least one socket; and activate an illumination source in response to a determination that at least one of the illumination configuration parameters are satisfied, wherein:

a first electronic device comprises a first near field communication (NFC) device; and the logic is further configured to activate the illumination source only when the first NFC device detects a second NFC proximate the first electronic device.

2. The apparatus of claim 1, wherein the at least one sensor comprises a photodetector and the logic is further configured to activate the illumination source only when an output from the photodetector indicates that the environment proximate the at least one socket is dark.

3. The apparatus of claim 1, wherein the at least one sensor comprises a proximity detector and the logic is further configured to activate the illumination source only when an output from the proximity detector indicates that an object is proximate the at least one socket.

4. The apparatus of claim 1, wherein the logic is further configured to:

deactivate the illumination source after a predetermined period of time.

5. The apparatus of claim 1, wherein the logic is further configured to:

deactivate the illumination source in response to detecting a connection with a remote device on the at least one socket.

6. A computer program product comprising logic instructions stored in a non-transitory computer readable medium which, when executed by a processor, configure the processor to:

receive at least one illumination configuration parameter;

monitor sensor conditions in at least one sensor proximate at least one socket; and activate an illumination source in response to a determination that at least one of the illumination configuration parameters are satisfied, wherein:

a first electronic device comprises a first near field communication (NFC) device; and the logic is further configured to activate the illumination source only when the first NFC device detects a second NFC proximate the first electronic device.

7. The computer program product of claim 6, wherein the at least one sensor comprises a photodetector and the logic is further configured to activate the illumination source only when an output from the photodetector indicates that the environment proximate the at least one socket is dark.

8. The computer program product of claim 6, wherein the at least one sensor comprises a proximity detector and the logic is further configured to activate the illumination source only when an output from the proximity detector indicates that an object is proximate the at least one socket.

9. The computer program product of claim 6, wherein the logic instructions further configure the processor to:

deactivate the illumination source after a predetermined period of time.

10. The computer program product of claim 6, wherein the logic instructions further configure the processor to:

deactivate the illumination source in response to detecting a connection with a remote device on the at least one socket.

* * * * *